United States Patent [19]

Takeuchi et al.

[11] Patent Number: 5,035,218

[45] Date of Patent: Jul. 30, 1991

[54] THROTTLE VALVE CONTROL APPARATUS FOR VEHICLES

[75] Inventors: Kanji Takeuchi, Gamagori; Yousuke Setaka, Anjo; Satoshi Arita, Chiryu, all of Japan

[73] Assignee: Nippondenso Co., Ltd., Kariya, Japan

[21] Appl. No.: 534,647

[22] Filed: Jun. 7, 1990

[30] Foreign Application Priority Data

Jun. 8, 1989 [JP] Japan ..... 1-146500

[51] Int. Cl.[5] ..... F02D 11/10

[52] U.S. Cl. ..... 123/361; 123/399; 180/197

[58] Field of Search ..... 123/342, 350, 351, 352, 123/361, 399, 396; 180/178, 179, 197

[56] References Cited

U.S. PATENT DOCUMENTS

| | | | |
|---|---|---|---|
| 4,367,805 | 1/1983 | Totani et al. | 123/361 X |
| 4,526,060 | 7/1985 | Watanabe | 123/376 |
| 4,702,208 | 10/1987 | Lombard et al. | 123/361 |
| 4,779,592 | 10/1988 | Takeuchi et al. | 123/399 |
| 4,848,297 | 7/1989 | Hickmann et al. | 123/342 |
| 4,848,505 | 7/1989 | Yoshizawa et al. | 123/396 X |
| 4,867,122 | 9/1989 | Kono et al. | 123/396 |
| 4,950,965 | 8/1990 | Kenny et al. | 123/352 X |
| 4,951,772 | 8/1990 | Peter et al. | 123/361 X |

FOREIGN PATENT DOCUMENTS 61-75024 4/1986 Japan .

*Primary Examiner*—Tony M. Argenbright

*Attorney, Agent, or Firm*—Cushman, Darby & Cushman

[57] ABSTRACT

A throttle valve control apparatus comprises a throttle valve element supported on a valve shaft, a wire for transferring a force of an accelerator operation part to the throttle valve element, a motor for driving the throttle valve, and a stopper member for transferring a driving force of the motor to the valve shaft. The stopper member has a gear part driven by the motor and a restraint part for restraining an opening degree of the throttle valve. A notch is provided near the restraint part. The driving force of the motor is transferred from the gear part to the stopper member at the time of traction control. The restraint part of the stopper member thus drives the throttle valve element in the close direction. The notch prevents the stopper member from coming in contact with the valve shaft.

3 Claims, 7 Drawing Sheets

THROTTLE VALVE CONTROL APPARATUS FOR VEHICLES

BACKGROUND OF THE INVENTION

1. Field of the Invention

This invention relates to a throttle valve control apparatus for controlling an opening of a throttle valve according to a traveling condition of a vehicle. Such apparatus is, for example, used on a traction control system or the like for preventing wheels from slipping.

2. Description of the Prior Art

An apparatus disclosed in Japanese Patent Unexamined Publication No. 61-75024 has been known well hitherto as existing in this kind of apparatus. The apparatus is provided with a buffer spring on a valve shaft of a throttle valve. The spring is coupled with a motor by a cable, thereby transferring a motor driving force to the throttle valve.

However, in such prior art apparatus, since the motor and the valve shaft of the throttle valve are coupled by the cable, problems inherent therein are such that a transfer mechanism becomes complicated the motor and the throttle valve are disposed separately to cause an inconvenience in mounting on a vehicle, and so forth.

SUMMARY OF THE INVENTION

This invention has been developed in view of the circumstances mentioned above, and its object is to enhance a mounting efficiency through a simple transfer mechanism.

To attain the aforementioned object, according to this invention, the apparatus comprises:

a throttle valve element supported on a valve shaft;

means for transferring an operating force of an accelerator operation part to the throttle valve element;

a motor for driving the throttle valve element;

a stopper member capable of transferring a driving force of the motor to the valve shaft, the stopper member having a gear part driven by the motor, and a restraint part for restraining an opening degree of the throttle valve element; and a notch provided near the restraint part, thereby preventing the stopper member from contacting the valve shaft.

According to this invention, a driving force of the motor is transferred from the gear part to the coupling member at the time, for example, of traction control, and then the coupling member is turned. Then, the throttle valve element is driven in the close direction by the restraint part of the coupling member. Since the coupling member is provided with the notch nearby the restraint part, the coupling member and the valve shaft are not brought into contact with each other in this case. Further, a cable is not required between the motor and the valve shaft, therefore the transfer mechanism will be simplified. Then, the motor and the throttle valve element can easily be unified, and, for example, the motor can be installed below the throttle valve element, thereby enhancing a mounting efficiency.

DETAILED DESCRIPTION OF PREFERRED EMBODIMENTS

A control apparatus according to a first embodiment of this invention will now be described with reference to the accompanying drawings.

Figure 1:
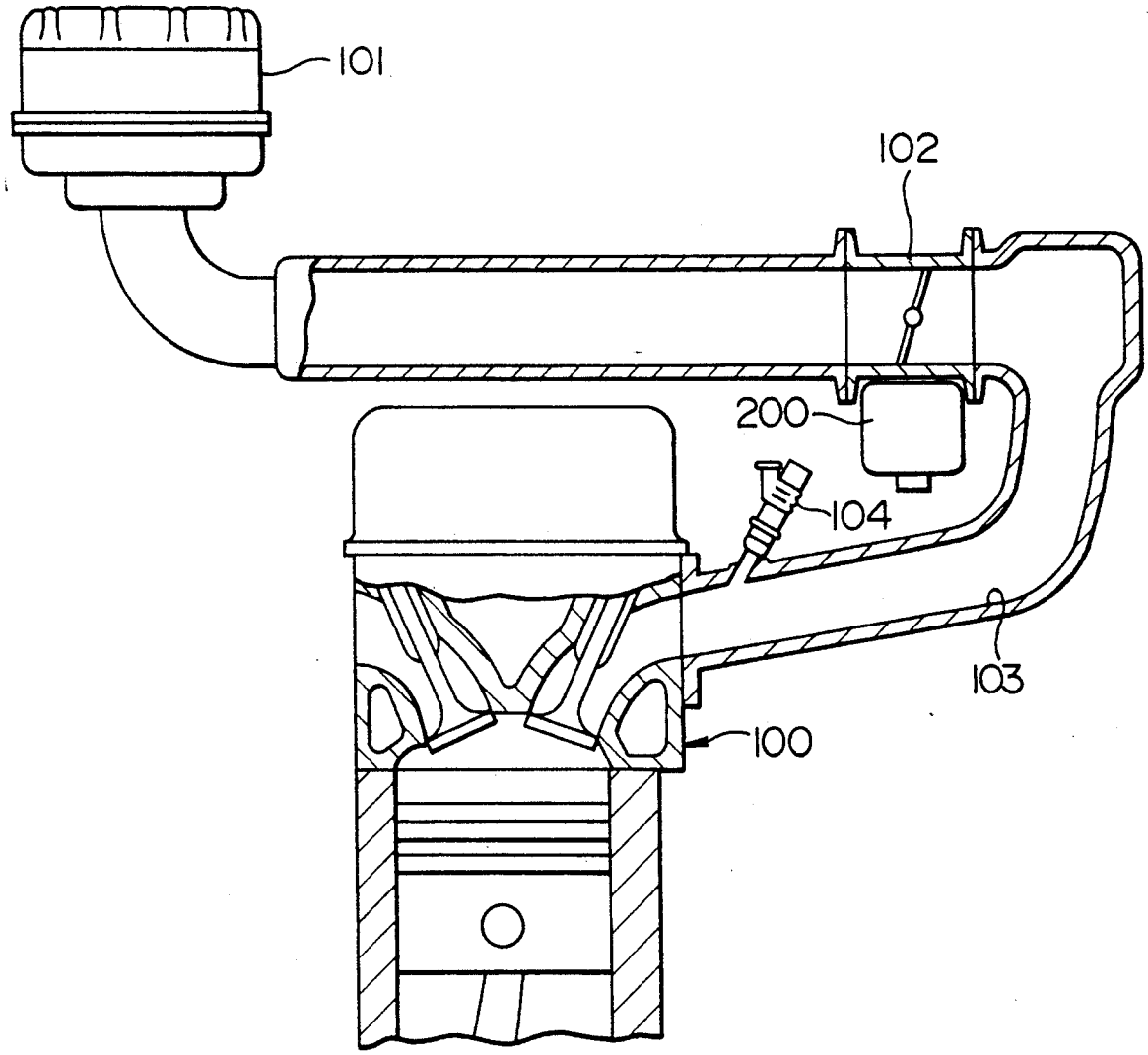
FIG. 1 is a view showing an engine to which the apparatus according to this invention is applied.

FIG. 1 shows a gasoline engine 100 to which the control apparatus of the first embodiment is applied. The engine 100 sucks air from an air cleaner 101 through a throttle body portion 102 and a surge tank 103. A fuel is fed from an injector 104 into the engine 100.

The throttle valve control apparatus 200 is provided on the throttle body portion 102. To minimize a suction resistance of the air, the surge tank 103 is constructed of an arc inlet pipe to provide a space below the throttle body portion 102. The throttle valve control apparatus 200 is disposed in such space.

Figure 2:
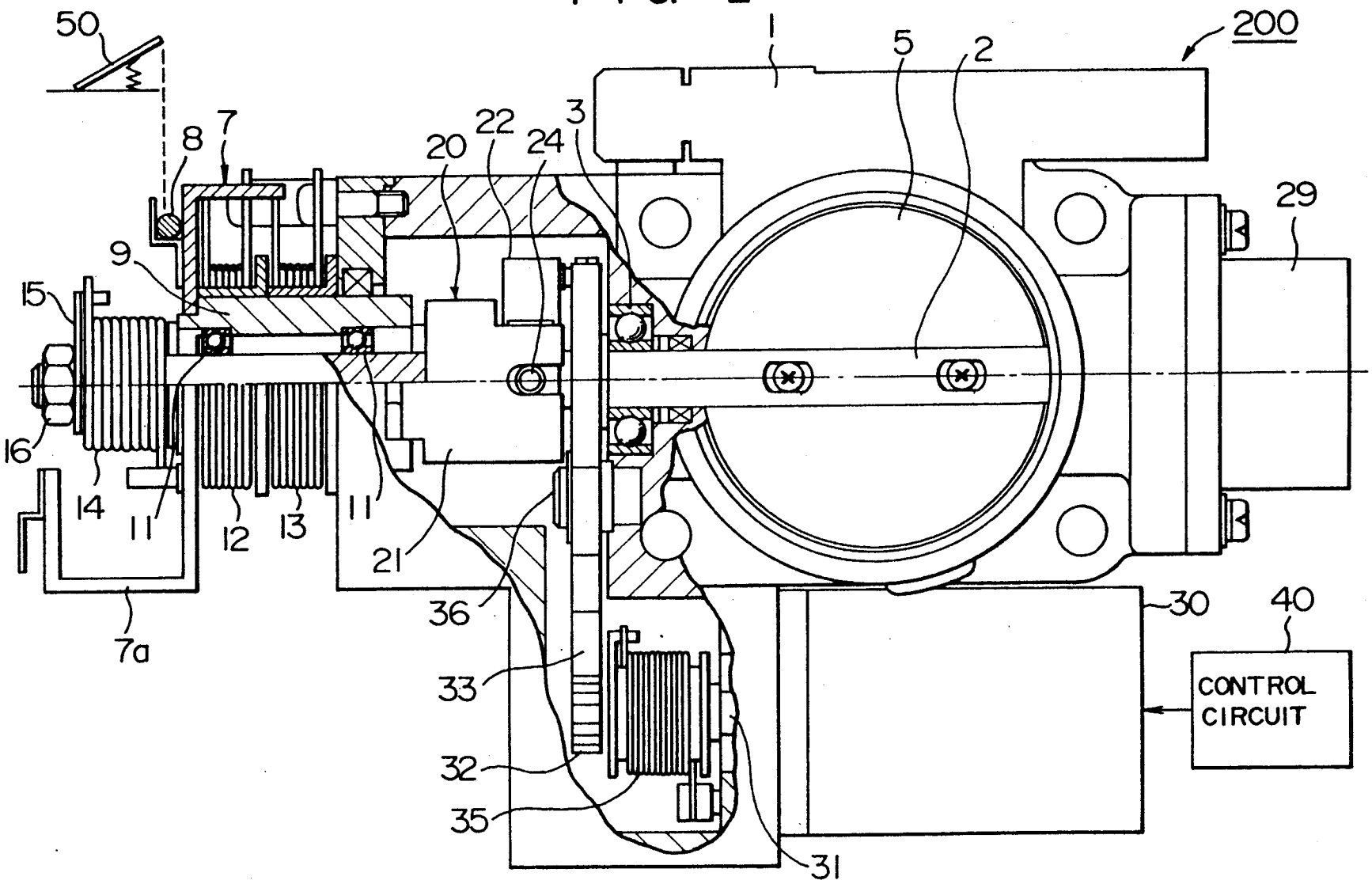
FIG. 2 is a fragmentary sectional view showing a first embodiment of this invention.

Referring to FIG. 2, in the throttle valve control apparatus 200, a valve shaft 2 is supported rotatably by bearings 3 in a throttle body 1 of aluminum die casting. A throttle valve element 5 is fixed on the valve shaft 2 with bolts. Then, as the valve shaft 3 turns, the throttle valve element 5 is operated to control a suction air quantity.

A lever 7 is provided on a one end portion of the valve shaft 2. The lever 7 is fixed on a rotary cylinder 9, and the rotary cylinder 9 is supported rotatably by two bearings 11 with reference to the valve shaft 2.

Then, return springs 12 and 13 working in the direction where the throttle valve element 5 is closed are coupled with the lever 7. The lever 7 is coupled with the valve shaft 2 by a spring 14 working in the direction where the throttle valve 5 is opened.

Figure 3:
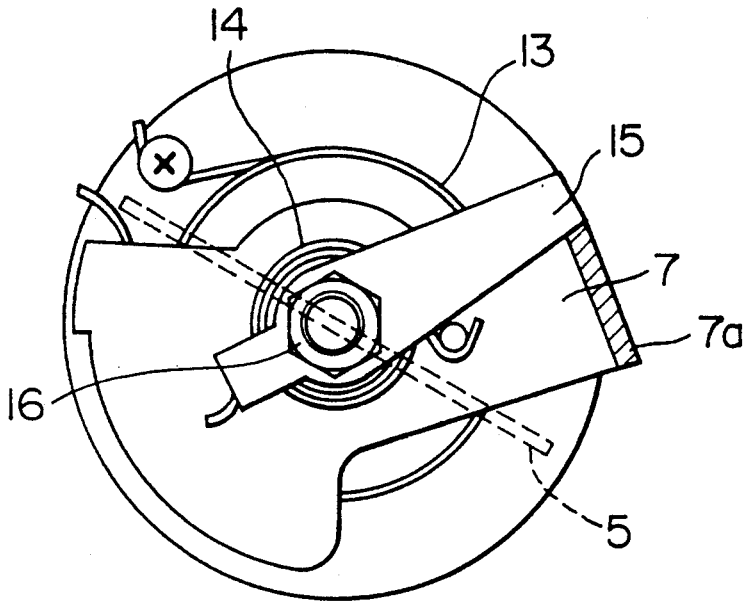
FIG. 3 is a side view showing a lever shown in FIG. 2.

A lever 15 is fixed on one end of the valve shaft 2 by a nut 16. A stopper *7a* is formed on the lever 7 so as to come in contact with the lever 15 as shown in FIG. 3, therefore the throttle valve element 5 cannot be opened beyond an opening degree restrained by the lever 7.

Referring back to FIG. 2, since the lever 7 is operated by an accelerator pedal 50 through a wire 8, the throttle valve 5 normally keeps the opening degree according to a manipulated variable of the accelerator pedal.

There is disposed a mechanical clutch 20 between the rotary cylinder 9 and the valve shaft 2. In cases where the mechanical clutch 20 is engaged, the lever 7 and the valve shaft 2 are coupled directly with each other. On the other hand, where the mechanical clutch 20 is disengaged, the lever 7 and the valve shaft 2 are coupled through the spring 14. A structure of the mechanical clutch 20 will be described hereinlater.

A throttle sensor 29 for detecting an opening degree of the throttle valve element 5 is provided on a second end of the valve shaft 2. Then, a driving motor 30 for the throttle valve element 5 is provided on the body 1 below the throttle valve element 5.

The motor 30 consists of a stepping motor or a DC motor, and is installed so as to make its output shaft 31 substantially parallel with the valve shaft 2. The motor 30 is controlled by a control circuit 40.

Then, the output shaft 31 of the motor 30 and the valve shaft 2 are coupled together through a coupling mechanism comprising a gear 32, a coupling member 33 and a return spring 35.

Figure 4:
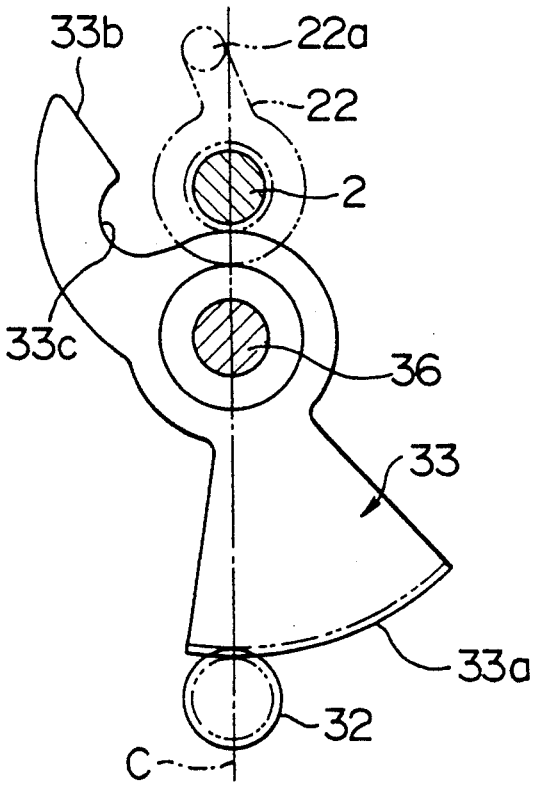
FIG. 4 is a side view showing a coupling member shown in FIG. 2.
Figure 5:
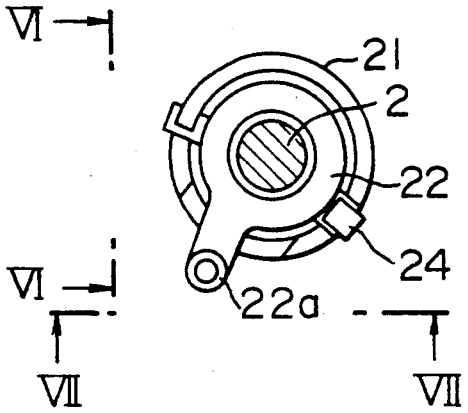
FIG. 5 is a sectional view showing a mechanical clutch shown in FIG. 2.

In the coupling mechanism, as shown in FIG. 4, the coupling member 33 is rotatable around a shaft 36. The coupling member 33 is provided on one end side thereof with a gear portion 33*a* which cooperates with the gear 32 to constitute a reduction mechanism. A rotor 22 of the clutch mechanism 20 described hereinlater is fixed on the valve shaft 2. A rodlike portion 22*a* of the rotor 22 is formed so as to come in contact with a restraint part 33*b* of the coupling member 33. Then, a notch portion 33*c* is formed on the coupling member 33 so as not to come in contact with the valve shaft 2. The gear 32, the shaft 36 and the valve shaft 2 are disposed on a center line C.

Next the mechanical clutch 20 will be described with reference to FIGS. 5 to 8. The mechanical clutch 20 transforms a turning force of the motor 30 into an axial thrust and couples or decouples the lever 7 with the valve shaft 2. The clutch 20 basically comprises the rotor 22 fixed to the valve shaft 2 to rotate integrally therewith, a movable cylinder 21 provided on an outer periphery of the rotor 22 and movable axially and circumferentially with respect to the valve shaft 2, and a compression spring 23 for pushing the movable cylinder 21 towards the rotary cylinder 9.

A pin 24 is press-fitted into the valve shaft 2. The pin 24 is engaged with an axial groove 21*a* of the movable cylinder 21 through a notch 22*b* of the rotor 22. Further, a pin 25 is press-fitted into the rotor 22. The pin 25 is engaged with a diagonal groove 21*b* of the movable cylinder 21.

Figure 6:
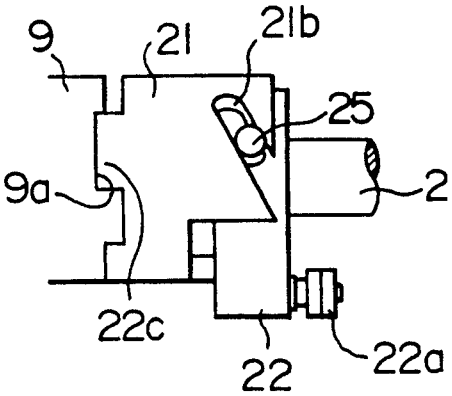
FIGS. 6 and 7 are side views showing the mechanical clutch shown in FIG. 2.
Figure 7:
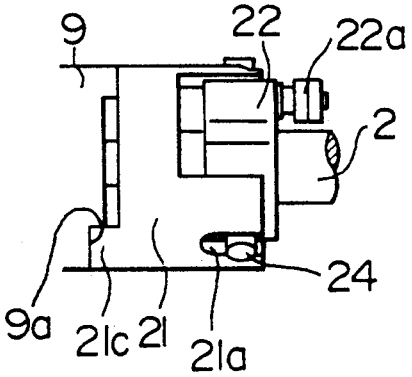
Figure 8:
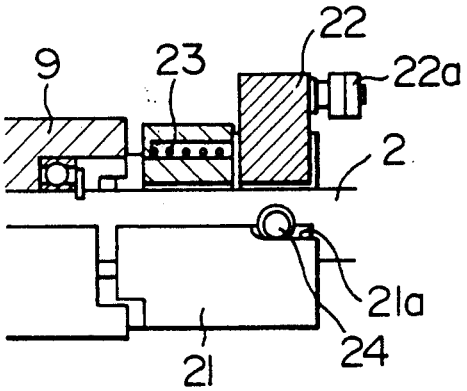
FIG. 8 is a fragmentary sectional view showing the mechanical clutch shown in FIG. 2.

As shown in FIG. 6, salient portion 22*c* is provided on one end of the movable cylinder 21 and equiangulary circumferentially spaced from each other so as to form a connection of the clutch. Recessions 9*a* are provided on one end of the rotary cylinder 21 and equiangulary circumferentially spaced from each other. When the salient portion 22*c* and the recession 9*a* are engaged, the clutch is connected, but when the salient portion 22*c* and the recession 9*a* are disengaged from each other, the clutch is disconnected.

In the aforementioned construction, operations at the times of normal driving and of traction control will be described.

Figure 9:
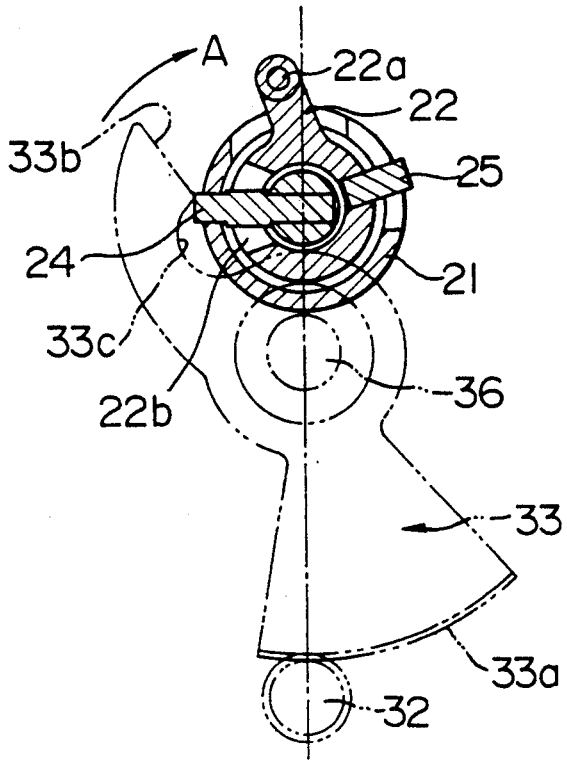
FIG. 9 and FIGS. 10A to 10C are sectional views showning the mechanical clutch shown in FIG. 2.

At the time of normal driving, the restraint part 33*b* of the coupling member 33 is set at a throttle full-open position shown in FIG. 9 under an action of the spring 35.

On the other hand, in the mechanical clutch 20, the movable cylinder 21 is pushed on a side of the rotary cylinder 9 by the compression spring 23, and thus the salient portion 22*c* and the recession 9*a* are engaged and connected with each other. Consequently, a turning force of the rotary cylinder 9 is transferred to the valve shaft 2 through the movable cylinder 21 and the pin 24. Thus, the lever 7 and the valve shaft 2 are coupled directly, and the throttle valve element 5 is controlled according to an operation of the accelerator pedal 50.

In this case even if there arises a stick fault on the throttle valve 5 for icing or other reason, since the mechanical clutch 20 is coupled, a torque can be transferred fully by the accelerator pedal 50, and then the throttle valve element 5 is operated smoothly.

Figure 10A:
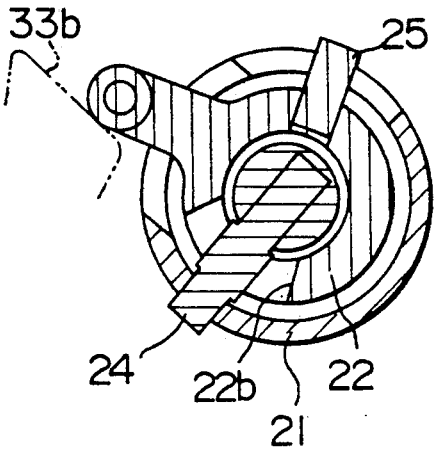

At the time of traction control, when the control circuit 40 detects a slip of wheels according to a signal from a wheel speed sensor (not shown), the motor 30 is energized, the coupling member 33 begins to turn in the direction indicated by an arrow A in FIG. 9 through the gear 32 and the gear part 33*a*. The restraint part 33*b* comes in contact with the rodlike portion 22*a* of the rotor 22 as shown in FIG. 10A, and then a turning force of the motor 30 is transferred to the rotor 22.

Figure 10B:
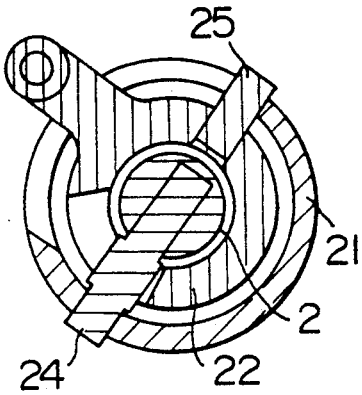
Figure 10C:
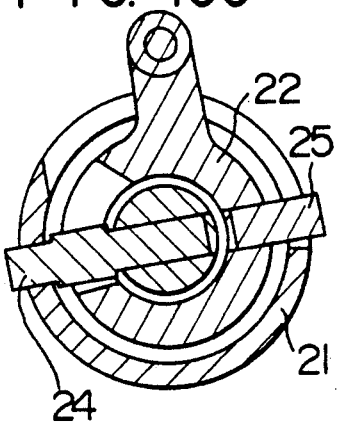

When the motor 30 rotates further, the rotor 22 comes in contact with the pin 24 as shown in FIG. 10B, and then the turning force of the motor 30 is transferred to the valve shaft 2. As a result, the valve shaft 2 turns as shown in FIG. 10C.

Figure 11A:
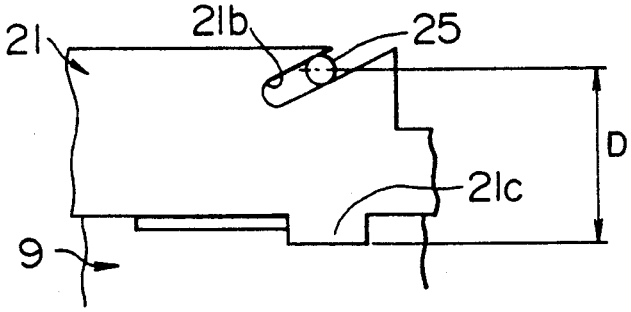
FIGS. 11A to 11C illustrate an operation of the clutch.
Figure 11B:
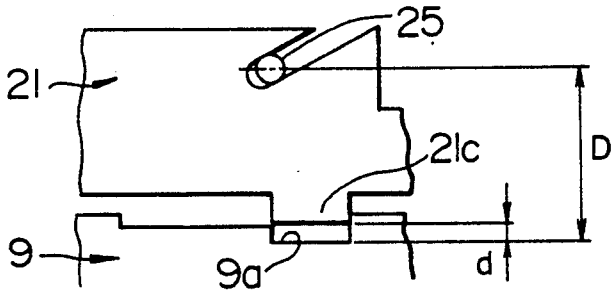
Figure 11C:
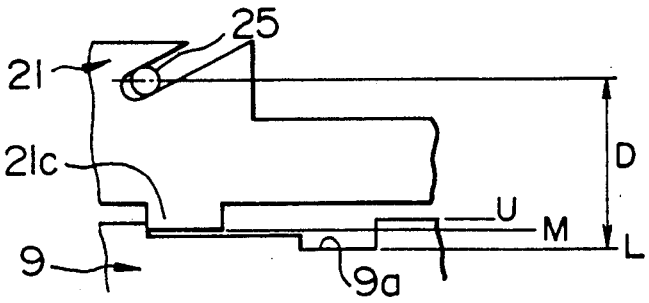

On the other hand, as shown in FIGS. 11A to 11C, the rotor 22 is restrained in the axial movement, and hence a distance D between the center of the pin 25 and the recession 9*a* is constant. The movable cylinder 21 is not capable of turning with reference to the valve shaft 2 due to the pin 24, but is movable axially.

Accordingly, as described above, when the motor 30 rotates and the rotor 22 turns, the pin 25 moves along the diagonal groove 21*b* from the state of FIG. 11A to the state shown in FIG. 11B, and there the movable cylinder 21 is moved axially by a distance d.

Thus, a salient portion 22*c* and the recession 9*a* are disengaged, the clutch is cut, and the movable cylinder 21 can turn to a position indicated in FIG. 11C.

Accordingly, a direct-coupled state of the lever 7 and the valve shaft 2 is released, and even if the accelerator pedal 50 has been stepped in, the throttle valve element 5 is driven in the close direction by the motor 30 against a force of the spring 14, thus a developing power of the engine is reduced and a slip of wheels is suppressed.

Then, if the motor 30 happens to be driven in in an abnormal manner or other, since the restraint part 33*a* of the coupling member 33 is only to restrain a maximum opening degree of the throttle valve element 5, the throttle valve 5 will never be opened beyond an opening degree determined by the lever 7 corresponding to an accelerator manipulated variable.

On the road, a surface of which has a low coefficient of friction like an iced road, the throttle valve element 5 is controlled about at a full-close position. However, since the notch portion 33*c* is formed on the coupling member 33, the coupling member 33 will never come in contact with the valve shaft 2.

At the time when a traction control is over, the control circuit 40 disenergizes the motor 30. The gear 32 is therefore driven by the spring 35, and the coupling member 33 is returned to an initial position of FIG. 1 through the gear part 33*a*.

In this case, the movable cylinder 21 also returns to an initial position by means of the springs 14 and 23. An end of the rotary cylinder 9 is constructed of three different height faces U, M, and L as shown in FIG. 11C. A projection forming the face U works as a stopper, the movable cylinder 21 returns to a position determined by a manipulated variable of the accelerator pedal 50, and the salient portion 22*c* and the recession 9*a* are engaged again.

While a mechanical clutch is used in the above-described embodiment, an electromagnetic clutch may be used otherwise.

Figure 12:
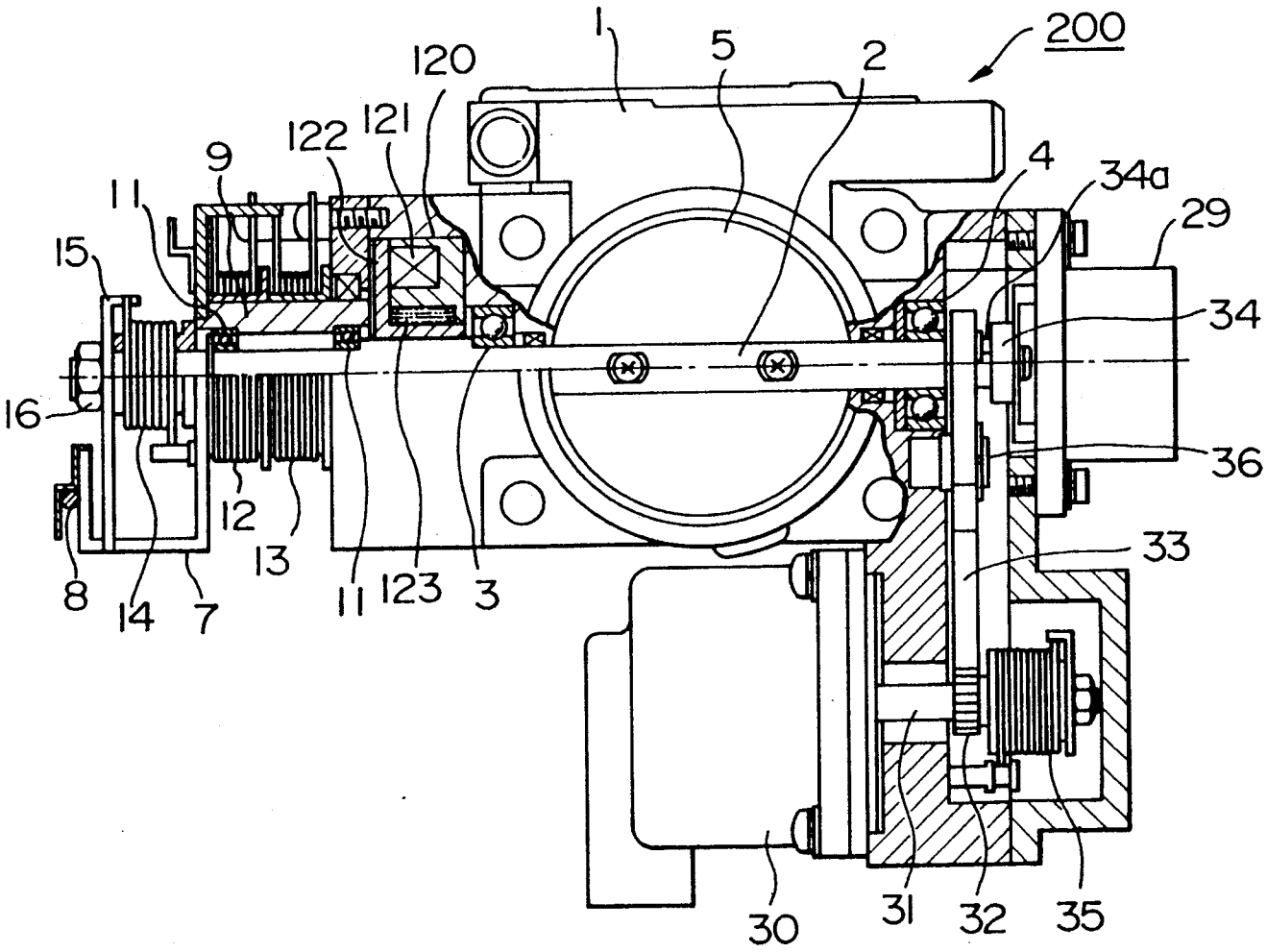
FIG. 12 is a fragmentary sectional view showing a second embodiment of this invention.

In FIG. 12, another apparatus according to a second embodiment uses an electromagnetic clutch 120. The clutch 120 comprises a stator including a solenoid coil 121, a moving core 122 provided on the valve shaft 2 movably in an axial direction only by a key coupling or other means, and a compression spring 123 for pushing the moving core 122 towards the cylinder 9.

The coupling mechanism is provided on a side of the throttle sensor 29. The mechanism comprises the gear 32, the coupling member 33, an actuating member 34 and the return spring 35.

Figure 13A:
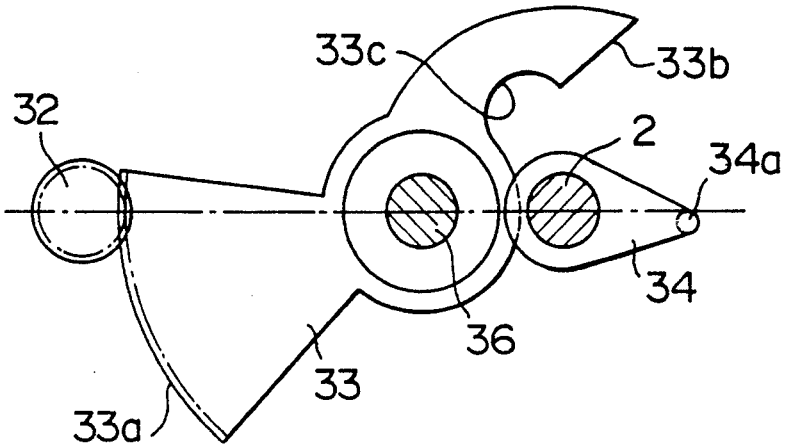
FIGS. 13A to 13C are sectional views showing a coupling member shown in FIG. 12.
Figure 13B:
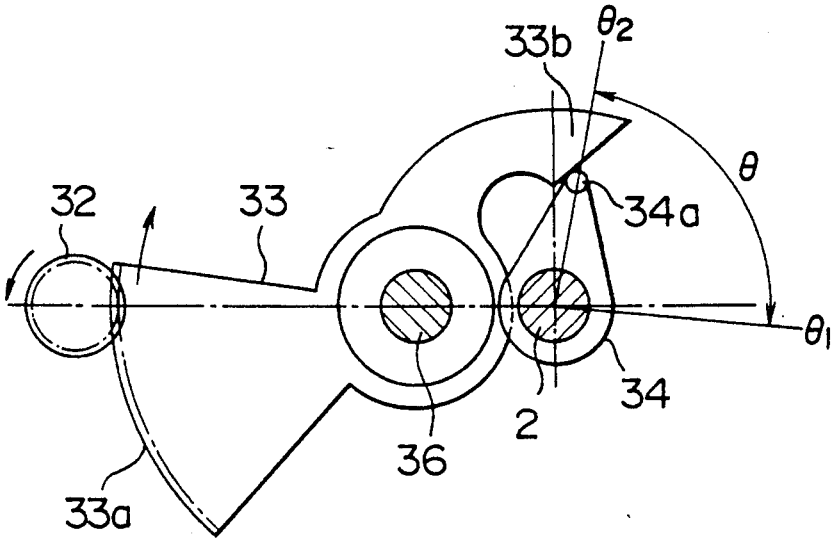
Figure 13C:
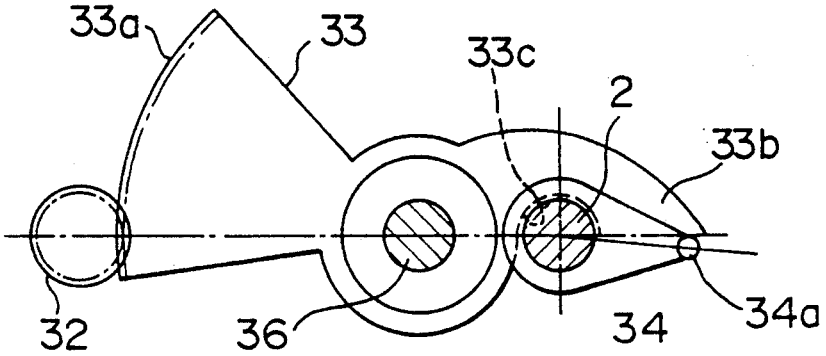

The actuating member 34 is fixed on the valve shaft 2 as shown in FIGS. 13A to 13C and is provided with a rodlike portion 34*a* which can contact with the restraint part 33*b* of the coupling member 33.

At the time of normal driving, the electromagnetic clutch 120 is turned off by the control circuit. Since the electromagnetic clutch 120 is constructed to have the clutch mechanism coupled at the time when disenergized, the lever 7 and the valve shaft 2 are coupled directly. According to an operation of the accelerator pedal 50, an opening degree of the throttle valve element 5 is controlled within a range $\theta$ between a position $\theta 1$ of the coupling member 34 when the throttle valve is closed full and a position $\theta 2$ of the coupling member 34 when the throttle valve is opened full, as shown in FIG. 13B.

On the other hand, at the time of traction control, when the control circuit detects a slip of wheels, the electromagnetic clutch 120 is energized to release the direct coupling of the lever 7 and the valve shaft 2. Therefore they are indirectly coupled through the spring 14.

Thereafter, the motor 30 is energized, and then the coupling member 33 begins to turn in the direction indicated by an arrow in FIG. 13B through the output shaft 31 and the gear 32. The restraint part 33*b* comes in contact with the rodlike portion 34*a* of the coupling member 34. When the motor 30 further rotates, the spring 14 begins to elongate, and then even if the accelerator pedal 50 is stepped in, the throttle valve element 5 is driven in the close direction, and thus a developing power of the engine is reduced and a slip of the wheels is suppressed.

What is claimed is:

1. A throttle valve control apparatus for vehicles comprising:

a throttle valve element supported on a valve shaft;

means for transferring an operating force of an accelerator operation part to said throttle valve element;

a motor for driving said throttle valve element;

stopper means for transferring a driving force of said motor to said valve shaft, said stopper means having a gear part driven by said motor, and a restraint part for restraining an opening degree of said throttle valve element; and a notch provided near said restraint part, thereby preventing said stopper from contacting said valve shaft.

2. A throttle valve control apparatus as defined in claim 1, wherein a mechanical clutch is disposed between said stopper means and said valve shaft, and the mechanical clutch transforms a turning force of said motor into an axial thrust and couples or decouples said stopper means with said valve shaft.

3. In a throttle valve control apparatus provided with link means for operating a single throttle valve element mechanically by an accelerator and motor means for operating said single throttle valve element electrically by an electric motor, the improvement comprising:

stopper means for restraining a maximum opening degree of said throttle valve element, said stopper means being driven by said motor means so as to modify said maximum opening degree; and clutch means for automatically isolating said link means and said throttle valve element when said motor means drives said stopper means so as to minimize said maximum opening degree.

* * * * *